US006481961B1

(12) United States Patent
Pai

(10) Patent No.: US 6,481,961 B1
(45) Date of Patent: Nov. 19, 2002

(54) STAGE FOR A CENTRIFUGAL SUBMERSIBLE PUMP

(75) Inventor: Cheng-Huai Pai, Taichung Hsien (TW)

(73) Assignee: Sea Chung Electric Co., Ltd., Taichung Hsien (TW)

( * ) Notice: Subject to any disclaimer, the term of this patent is extended or adjusted under 35 U.S.C. 154(b) by 0 days.

(21) Appl. No.: 09/898,696

(22) Filed: Jul. 2, 2001

(51) Int. Cl.[7] ..... F04D 29/44

(52) U.S. Cl. ..... 415/199.2; 415/199.3; 415/211.2

(58) Field of Search ..... 415/199.1, 199.2, 415/199.3, 185, 191, 208.2, 211.2

(56) References Cited

U.S. PATENT DOCUMENTS 2,145,598 A * 1/1939 Hait ..... 277/336
3,730,641 A * 5/1973 Gordon ..... 415/199.3
4,708,589 A * 11/1987 Nielsen et al. ..... 415/199.2
4,923,367 A * 5/1990 Zimmer ..... 415/199.1

* cited by examiner

*Primary Examiner*—Edward K. Look
*Assistant Examiner*—Ninh Nguyen
(74) *Attorney, Agent, or Firm*—Kolisch Hartwell, P.C.

(57) ABSTRACT

A stage for a centrifugal submersible pump has a base, a connecting plate and an impeller. The base has multiple ribs integrally formed in the base. The connecting plate is securely attached to one end of the base. The connecting plate has an annular core and a resilient coating. The coating is coated around the core. A central hole is defined through the resilient coating. The impeller is supported on the connecting plate. Accordingly, the structure of the base is simplified. The cost for manufacturing the stage is reduced. In addition, because the impeller does not abut the base but is supported on the connecting plate with the resilient coating, the wear between the base and the impeller can be avoided. The useful life of the stage is prolonged.

3 Claims, 4 Drawing Sheets

STAGE FOR A CENTRIFUGAL SUBMERSIBLE PUMP

BACKGROUND OF THE INVENTION

1. Field of the Invention

The present invention relates to a stage, and more particularly to a stage with a simplified structure for a centrifugal submersible pump.

2. Description of Related Art

With reference to FIGS. 3 and 4, a conventional stage for a centrifugal submersible pump comprises a base (40) and an impeller (30). The base (40) is a segmented hollow cylinder with a top end and a bottom end. Multiple spiral ribs (41) are integrally formed in the base (40). A flange (42) is formed on the top end of the base (40). A central hole (43) is defined through the top flange (42). The impeller (30) has multiple vanes (32) in the impeller (30). The impeller (30) is rotatably supported on the top flange (42) of the base (40). An annular lip (31) extends from the bottom of the impeller (30) and into the central hole (43) in the base (40).

In use, the impellers (30) of multiple stages are pressed onto a shaft (300) extending from a motor (not shown) for the centrifugal submersible pump. When the motor is switched on, the impellers (30) will rotate with the shaft (300). A water vortex will be generated along the ribs (41) in the base (40) by the vanes (32) in the impeller (30), and the water is pressurized. Consequently, the water in the deep can be pushed to a high level.

However, the conventional stage has the following shortcomings:

1. Because the ribs (41) and the top flange (42) of the base (40) must be fabricated in a casting process, the structure of the base (40) and the mold to form the base (40) are complex. A particular problem is that each rid (41) in the base (40) must be formed with a spiral or curved shape to provide the least resistance while guiding the water vortex to the impeller inlet. To form the conventional base (40) is very difficult and expensive.

2. The base (40) and the impeller (30) are made of metal materials. The impeller (30) is supported on the top flange (42) of the base (40), and the lip (31) on the base (30) extends into the central hole (43) in the base (40). Therefore, the top flange (42) of the base (40), the inner surface of the central hole (43) in the base (40), the bottom of the impeller (30) and the lip (31) are easily worn down as the impeller (30) rotates relative to the base (40). The useful life of the stage is short.

To overcome the shortcomings, the present invention provides an improved stage to mitigate or obviate the aforementioned problems.

SUMMARY OF THE INVENTION

The main objective of the invention is to provide an improved stage for a centrifugal submersible pump to simplify the structure of the stage and the process for manufacturing the stage. The stage has a segmented base, a connecting plate and an impeller. The segmented base has an open top end, an open bottom end and multiple spiral ribs integrally formed in the base. The connecting plate is securely attached to top end of the base. The connecting plate has an annular core and a resilient coating. The coating is coated around the core and pressed into the top of the base. A central hole is defined through the resilient coating. The impeller is rotatably supported on the connecting plate.

Accordingly, the structure of the base is simplified. The cost for manufacturing the stage is reduced. In addition, because the metal impeller will not abut the metal base but supported on the connecting plate having the resilient coating, the wear between the base and the impeller can be prevented. Only the coating on the connecting plate will wear, and the connecting plate can be replaced to restore the pump to full operations without having to replace the base and the impeller.

Other objects, advantages and novel features of the invention will become more apparent from the following detailed description when taken in conjunction with the accompanying drawings.

DETAILED DESCRIPTION OF PREFERRED EMBODIMENT

Figure 1:
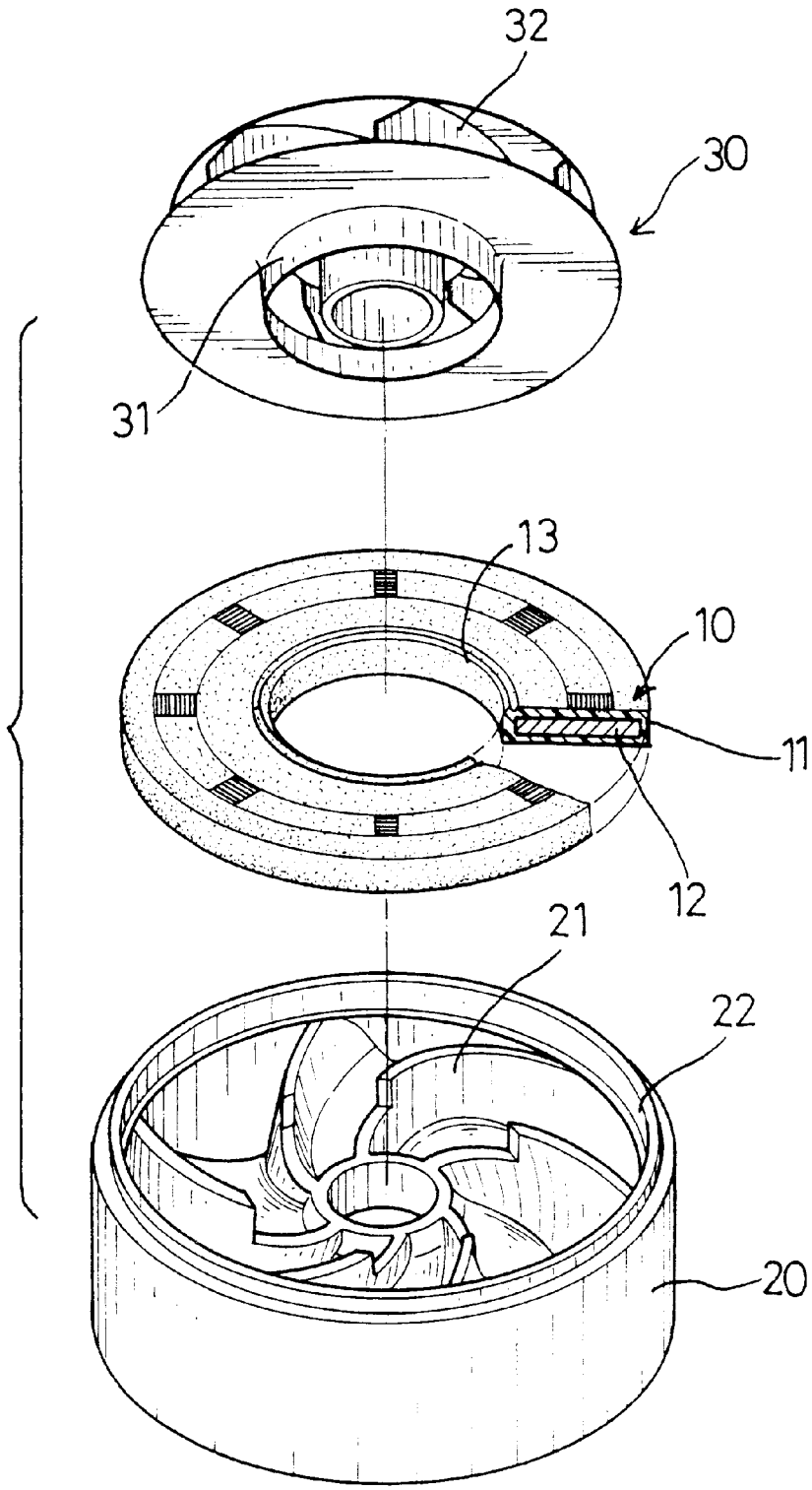
FIG. 1 is an exploded perspective view of a stage for a centrifugal submersible pump in accordance with the present invention.
Figure 2:
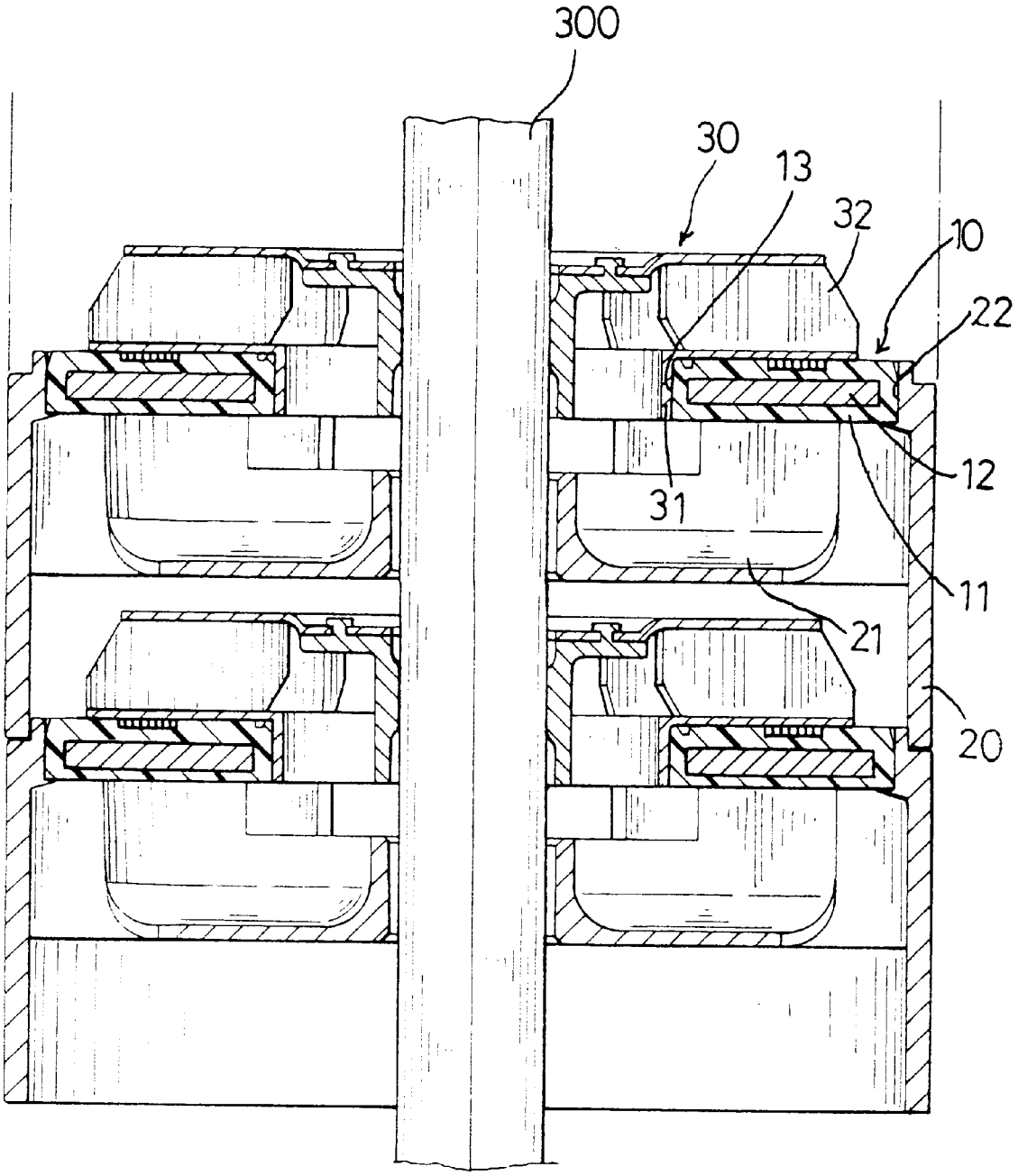
FIG. 2 is a side plan view in partial section of multiple stages for a centrifugal submersible pump in FIG. 1 mounted on a shaft.
Figure 3:
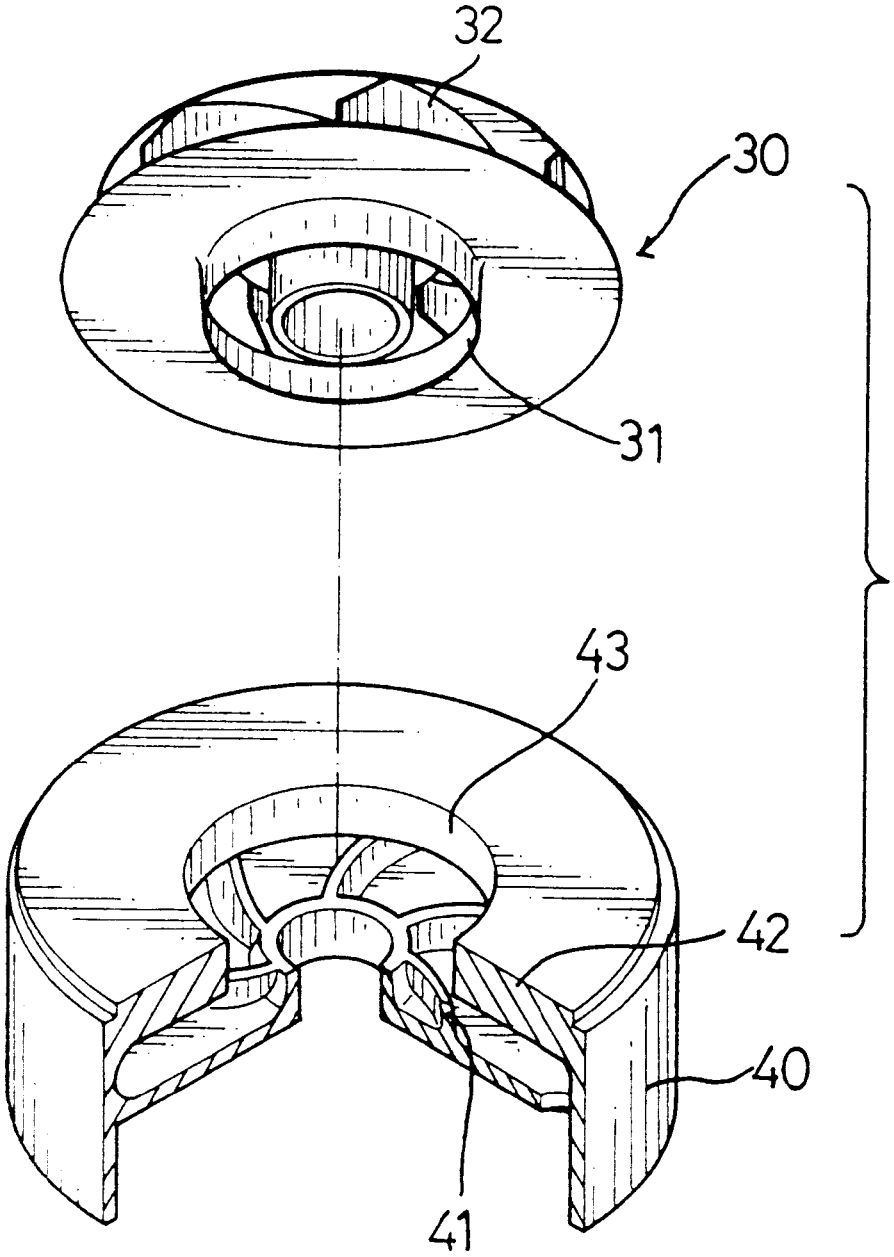
FIG. 3 PRIOR ART
FIG. 3 is an exploded perspective view of a conventional stage for a centrifugal submersible pump in accordance with the prior art.
Figure 4:
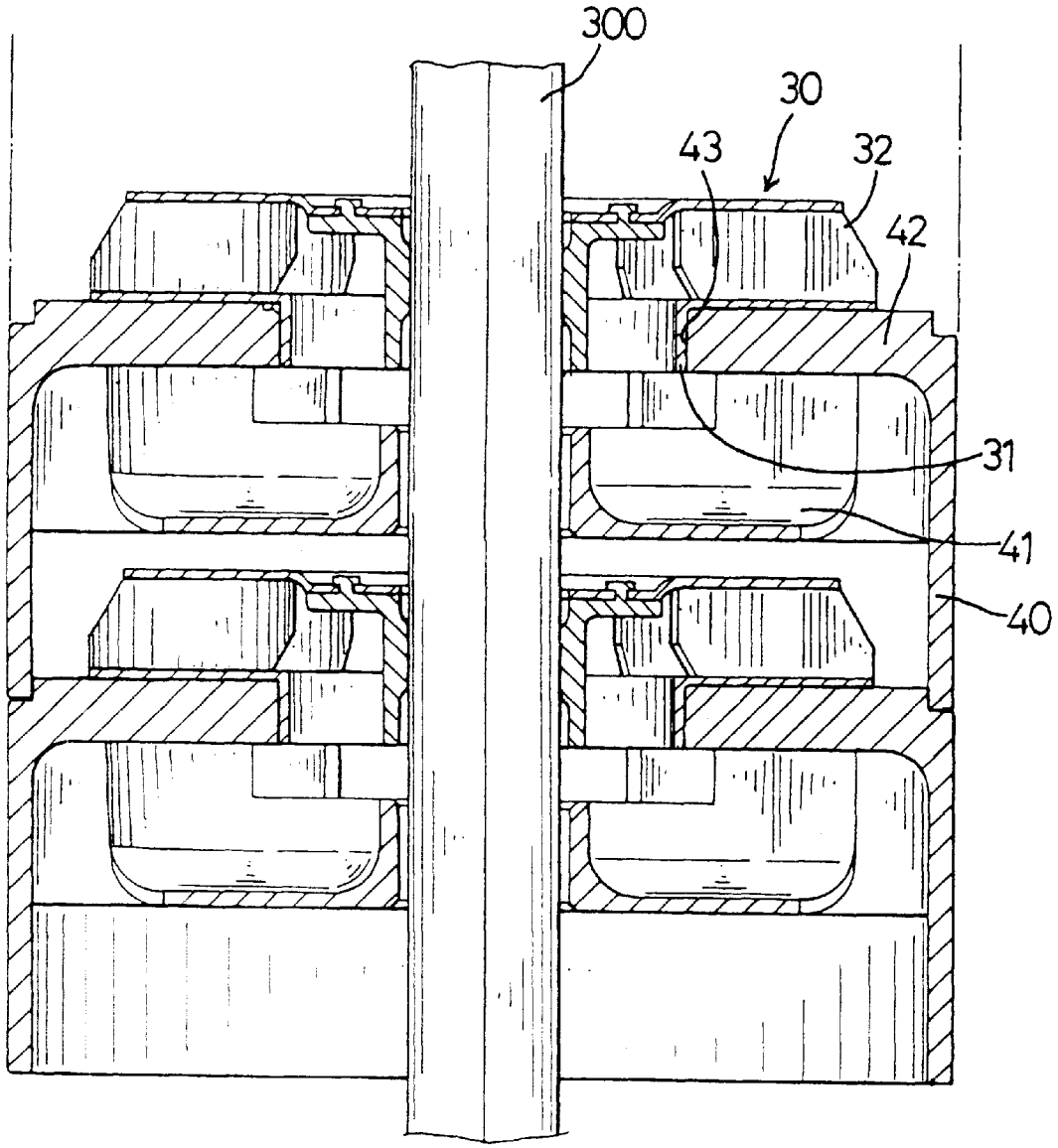
FIG. 4 PRIOR ART
FIG. 4 is a side plan view in partial section of multiple stages for a centrifugal submersible pump FIG. 3 mounted on a shaft.

With reference to FIGS. 1 and 2, a stage for a centrifugal submersible pump in accordance with the present invention comprises a segmented base (20), a connecting plate (10) and an impeller (30). The segmented base (20) has an open top end and an open bottom end and is a hollow cylinder with multiple spiral ribs (21) integrally formed in the base (20). Each rib (21) has a spiral or curved shape to guide the water to the inlet of the impeller (30). An annular lip (22) axially extends from the top of the base (20).

The connecting plate (10) is mounted in the lip (22) on the top of the base (20). The connecting plate (10) comprises an annular core (12) and a coating (11). The coating (11) is made of a flexible material such as rubber, plastic, silicone or the like. The coating (11) is coated around the core (12). A central hole (13) is defined in the coating (11). The coating (11) abuts the inner surface of the annular lip (22) as the connecting plate (10) is mounted in the annular lip (22) on the base (20).

The impeller (30) is rotatably supported on the connecting plate (10). A lip (31) extends downward from the bottom of the base (30) and into the central hole (13) in the coating (11) of the connecting plate (10). Multiple vanes (32) are formed in the impeller (30).

In use, the impellers (30) of multiple stages are pressed onto a shaft (300) of a motor for the centrifugal submersible pump. When the motor is switched on, the impellers (30) will rotate with the shaft (300). A water vortex will be generated, and the water will be pressurized by the vanes (32) in the impellers (30). Water can be pushed to a high level.

Because the structure of the base (20) is simplified by only having multiple ribs (21) formed in a cylinder, the mold to fabricate the base (20) is simplified and the cost for manufacturing the base (20) is reduced. In addiction, because the impeller (30) is supported on the connecting plate (10) with a resilient coating (11), the wear between the base (20) and the impeller (20) can be avoided. The useful life of the stage is prolonged.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stage for a centrifugal submersible pump, the stage comprising:

a base having a top, a bottom and multiple spiral ribs integrally formed in the base;

a connecting plate securely attached into the top of the base and having:

an annular core;

a resilient coating coated around the annular core and abutting an inner surface of the base; and a central hole defined through the resilient coating; and an impeller with multiple vanes rotatably supported on the connecting plate and adapted to be pressed onto a shaft of a motor for the centrifugal submersible pump and be rotated by the shaft.

2. The stage as claimed in claim 1, wherein an annular lip extends downward from a bottom of the impeller and into the central hole in the connecting plate so as to rotatably support the impeller on the connecting plate.

3. The stage as claimed in claim 1, wherein an annular lip axially extends from the base to interference sit with the connecting plate.

* * * * *